United States Patent [19]

Mrlik

[11] 3,936,250

[45] Feb. 3, 1976

[54] CORNER SEAL COIL SPRING ARRANGEMENT FOR ROTARY ENGINE

[75] Inventor: Jerry R. Mrlik, Birmingham, Mich.

[73] Assignee: General Motors Corporation, Detroit, Mich.

[22] Filed: July 10, 1974

[21] Appl. No.: 487,173

[52] U.S. Cl. ..... 418/121; 418/122; 418/142

[51] Int. Cl.[2] ..... F01C 19/04; F01C 19/08; F04C 27/00

[58] Field of Search ..... 418/120–123, 418/142; 123/8.01

[56] References Cited

UNITED STATES PATENTS

| | | | |
|---|---|---|---|
| 3,286,912 | 11/1966 | Tado | 418/120 |
| 3,485,217 | 12/1969 | Irgens | 418/121 |
| 3,829,252 | 8/1974 | Nakano | 418/142 |

FOREIGN PATENTS OR APPLICATIONS

| | | | |
|---|---|---|---|
| 1,135,708 | 8/1962 | Germany | 418/121 |

*Primary Examiner*—John J. Vrablik
*Attorney, Agent, or Firm*—Ronald L. Phillips

[57] ABSTRACT

The corner seals and apex seals in a rotary engine are structured to permit coil springs to be concentrically arranged with and bias the corner seals.

3 Claims, 5 Drawing Figures

CORNER SEAL COIL SPRING ARRANGEMENT FOR ROTARY ENGINE

This invention relates to a corner seal coil spring arrangement for a rotary engine and more particularly to a coil spring that is concentrically arranged with and biases the corner seals.

In current commercial rotary engines, it is common practice to have a gas sealing grid on the rotor which includes corner seals that provide sealed junctures between apex seals and side seals. In such an arrangement, the springs which bias the corner seals against the engine's stationary side walls are typically horseshoe shaped leaf or wire springs that produce unbalanced off-center loading which may bind the corner seals and, in addition, are limited to a load based on maintaining a reasonable spring rate.

An object of the present invention is to provide a new and improved corner seal coil spring arrangement for a rotary engine.

Another object is to provide a corner seal coil spring arrangement for a rotary engine that provides balanced loading on the corner seal that is not limited by a reasonable spring rate.

Another object is to provide a corner seal coil spring arrangement for a rotary engine wherein the coil spring is mounted concentric with the corner seal in a space formed by restructuring of both the corner seal and apex seal to provide balanced loading on the corner seal to avoid binding of the corner seal with such loading not limited by the maintenance of a reasonable spring rate.

These and other objects of the present invention will become more apparent from the following description and drawing in which.

Figure 1:
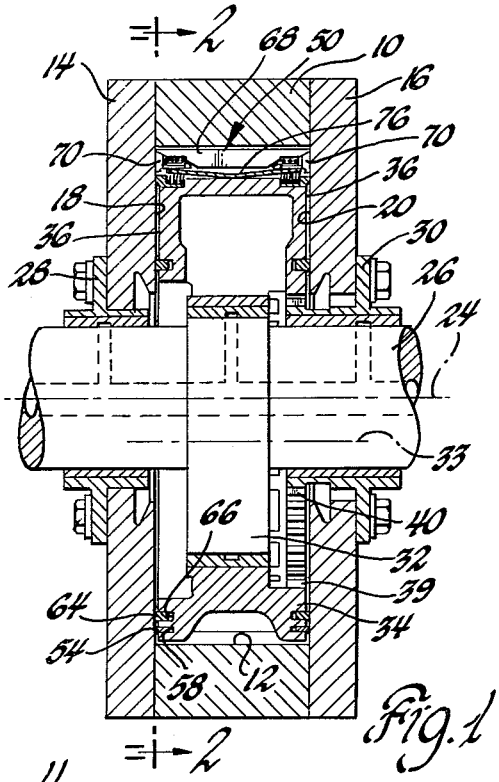
FIG. 1 is an elevational view with parts in section of a rotary combustion engine having corner seal coil spring arrangements according to the present invention.
Figure 2:
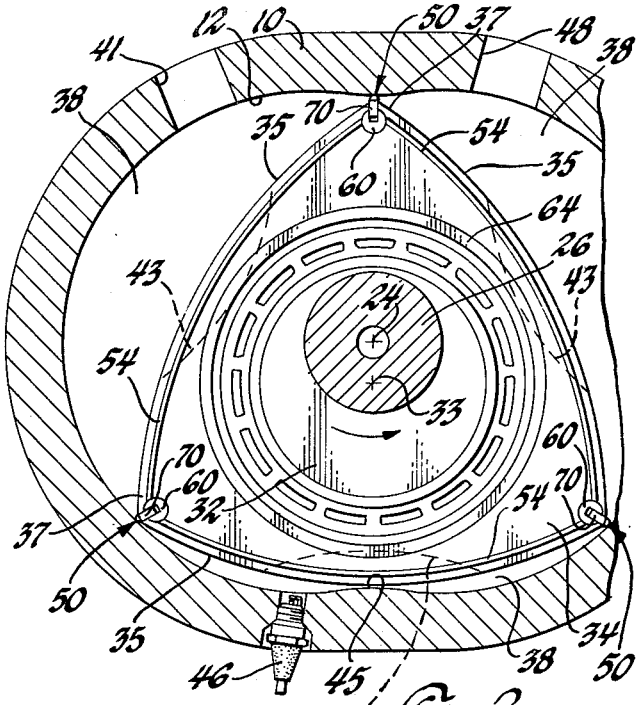
FIG. 2 is a view of the engine taken along the line 2—2 in FIG. 1.

The corner seal coil spring arrangement according to the present invention is for use in rotary engines including rotary combustion engines, compressors, pumps and the like. Referring to FIG. 1, the rotary engine may, for example, be an internal combustion engine of current production type having a stationary outer body comprising a rotor housing 10 having an inwardly facing inner peripheral wall 12 and a pair of end housings 14 and 16 having parallel, oppositely facing, spaced, inner end walls 18 and 20, respectively. The housing parts are rigidly secured together by bolts, not shown, with the inner walls 12, 18 and 20 cooperatively providing a cavity. Referring to FIG. 2, the peripheral wall 12 is in the shape of a two-lobe epitrochoid or a curve parallel thereto whose centerline is indicated at 24. A crankshaft 26 extends through the cavity and is rotatably supported in bearing lined collars 28 and 30 that are bolted to the end housings 14 and 16, respectively, as shown in FIG. 1, the crankshaft axis being coincident with the centerline 24, parallel to the peripheral wall 12 and perpendicular to the end walls 18 and 20. The crankshaft 26 is provided in the cavity with an eccentric 32 whose centerline 33 parallels the crankshaft axis 24. A rotor 34 has a central hub having a bearing press-fitted therein which is received on the eccentric 32 whereby the rotor 34 is supported in the cavity for rotation about the eccentric's centerline 33 which is thus the rotor's axis. The rotor 34 has the general shape of a triangle with three outwardly facing convex peripheral flanks or faces 35 which face the peripheral wall 12 and parallel sides 36 which face the end walls 18 and 20. As the rotor turns with respect to the peripheral wall 12 on the turning crankshaft 26, each of the rotor's corners or apexes 37 remains close to the peripheral wall 12 whereby the rotor faces 35 cooperate with the wall 12 and also with the end walls 18 and 20 to define three variable volume working chambers 38 that are spaced around the rotor and move with the rotor within the housing as the rotor rotates about its axis while planetating with respect to the crankshaft axis.

With the two-lobed peripheral wall 12 and the three corner rotor 34, each of the working chambers 38 sequentially expands and contracts between minimum and maximum volume twice during each rotor revolution in fixed relation to the housing by forcing the rotor to rotate at one-third the speed of the crankshaft. This is accomplished by gearing comprising an internal tooth gear 39 which is concentric and integral with rotor 34. The gear 39 meshes with an external tooth gear 40 which is received with clearance about and is concentric with the crankshaft 26 and is made stationary by being formed integral with the right-hand collar 30 as shown in FIG. 1. The gear 39 has one and one-half times the number of teeth as the gear 40 to provide the required speed ratio of 3:1 between the crankshaft and rotor.

A combustible air-fuel mixture from a suitable carburetor arrangement, not shown, is made available to the working chambers 38 as they expand through an intake port 41 in rotor housing 10 as the rotor rotates in the direction indicated by the arrow in FIG. 2. A single channel or recess 43 is provided in the center of each chamber face of the rotor to provide for the transfer of working gases past the peripheral wall's cusp 45 when a rotor face is near its top-dead-center position, as shown in FIG. 2, so that the chambers are not divided by the cusp 45 at the time when combustion is to occur therein. A spark plug 46 is mounted in the rotor housing 10 adjacent the cusp 45 with its electrodes exposed to the working chambers. As the rotor planetates, the working chambers successively draw in fuel mixture as the leading rotor corners pass the intake port 41. The trailing corner of the rotor for each chamber then closes this chamber to the intake port whereafter the fuel mixture is thus trapped and then compressed and when the rotor face of this chamber is in the vicinity of top-dead-center, this mixture is ignited at the completion of the compression phase, there being provided a suitable ignition system, not shown, for providing voltage to the spark plug at the proper time. Upon ignition of the mixture in each working chamber the peripheral wall takes the reaction forcing the rotor to continue turning while the gas is expanding. The leading rotor corner of each working chamber eventually traverses an exhaust port 48 in the rotor housing as they again contact whereby the exhaust products are then expelled to complete the cycle.

Figure 4:
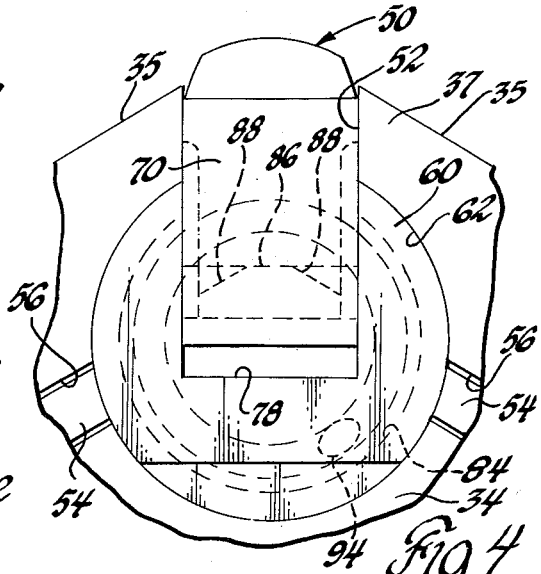
FIG. 4 is a view taken along the line 4—4 in FIG. 3.
Figure 5:
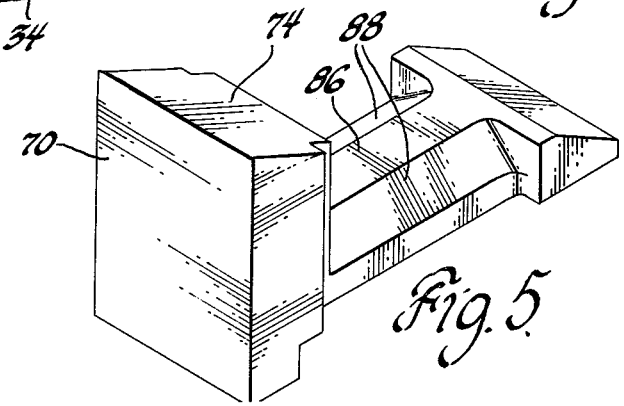
FIG. 5 is a perspective view of the apex seal end pieces that assist in accommodating the corner seal coil springs.

Sealing of the chambers 38 for such four-cycle internal combustion engine operation is mandatory and is typically provided by three apex seals 50 which are rectangularly shaped in cross-section as shown in FIG. 4, and are each mounted in an axially extending radially outwardly facing rectangularly shaped slot 52 that is located in each apex or corner 37 of the rotor and extends the axial width thereof as shown in FIG. 1. Three arcuate shaped side seals 54 are mounted in accommodating axially outwardly facing grooves 56 in each rotor side and extend adjacent a rotor face between two apex seals 50 and are urged by wave springs 58 located therebehind to engage the opposing end wall. Furthermore, three cylindrically shaped corner seals 60 are each mounted in a cylindrical hole 62 in each rotor side corner with each corner seal urged to engage the opposing end wall by corner seal coil spring arrangements according to the present invention as described in more detail later and providing a sealed juncture between the adjacent ends of two side seals 54 and one apex seal 50 as shown in FIG. 4. In addition to this gas sealing arrangement or grid there is also provided radially inward thereof a circular oil seal 64 that is mounted in an accommodating axially outwardly facing groove in each rotor side and is urged by a wave spring 66 to engage the opposing end wall.

Figure 3:
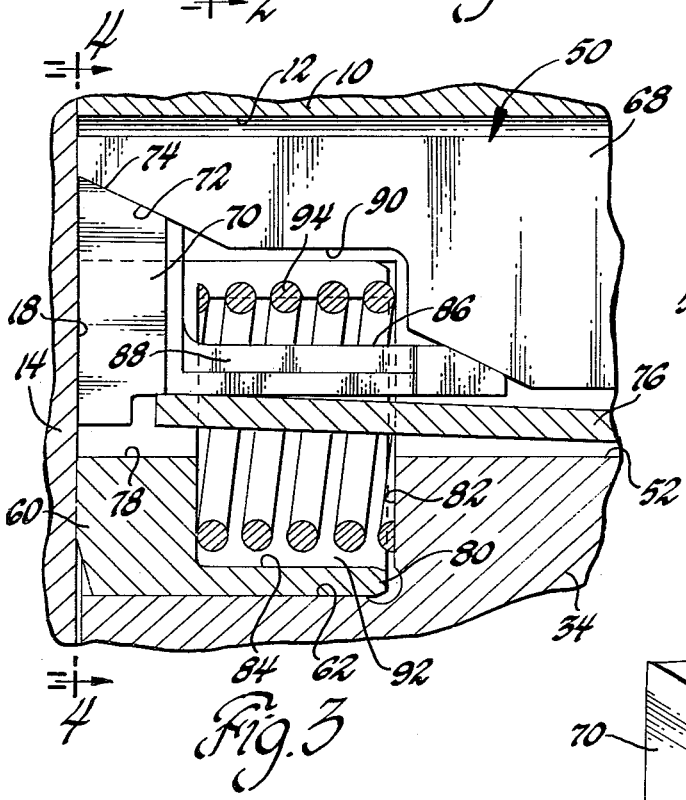
FIG. 3 is an enlarged view of one corner of the rotor in FIG. 1 showing one of the corner seal coil spring arrangements.

In the gas sealing arrangement at each corner of the rotor as best shown in FIGS. 1, 3 and 4, the apex seal 50 in this instance is a three-piece seal which is chosen for very tight sealing. The apex seal comprises a center piece 68 for engaging the peripheral wall 12 and a pair of identical end pieces 70 for engaging the opposing end walls 18 and 20. The apex seal center piece 68 and end pieces 70 have mating ramps or inclined interfaces 72 and 74 and a leaf spring 76 which is seated at its middle on the bottom of the apex seal slot 52 engages at or near its outer ends with the bottom of the end pieces 70 to apply a radially outwardly acting force thereon. In response, the mating ramps 72 and 74 provide a wedging action that forces the center apex seal piece 68 radially outwardly against the peripheral wall 12 while the end pieces 70 are forced axially outwardly against the opposing end walls 18 and 20. Furthermore, each of the corner seals 60 has a rectangularly shaped radially outwardly facing slot 78 which closely receives the adjoining apex seal end piece 70 to permit sliding therebetween in mutually perpendicular directions of movement on the rotor while sealing is maintained therebetween. Typically, the corner seals 60 are biased to continuously engage the respective end walls 18 and 20 by separate leaf or wire springs located between the flat C-shaped inner end 80 of the corner seals and the flat C-shaped bottom 82 of the accommodating corner seal holes 62. These typical corner seal springs have a horseshoe shape when viewed from the front and a $\gamma$ shape when viewed from the side and as a result, they effect off-center loading on the corner seal which may restrict the movement thereof, and unless restrained from turning relative to the corner seals may engage at one end with one side of the apex seal and restrict its movement. Furthermore, such springs are normally limited to applying a load on the corner seal based on maintaining a reasonable spring rate and may as a result not have a high enough spring load to overcome the frictional forces produced by carbon deposits and varnish that accummulate as a result of combustion. Such known corner seal spring designs are disclosed in U.S. Pat. No. 3,711,229.

According to the present invention there are provided balanced biasing loads on the corner seals by concentrically arranged multi-coil coil springs whose loads are not limited by the maintenance of a reasonable spring rate. This is accomplished by forming a concentric blind bore or hole 84 in the backside of each corner seal 60 which may extend about half the length thereof as shown in FIG. 3. In addition, there is formed both a triangular shaped notch 86 with chamfers 88 on either side in the interface 74 of each end apex seal piece 70 and a triangular shaped notch 90 without chamfers in each interface 72 of the apex seal center piece 68. The blind bore 84 in each corner seal 60 cooperates with the rectangularly shaped opening through the apex seal provided by the notch 86 in the apex seal end piece 70 and the notch 90 in the apex seal center piece 68 to provide an annular space 92 within the confines of hole 62 and about the end of the apex seal spring 76 concentric with the corner seal 60 and it is in this space that a coil spring 94 having a plurality of turns is mounted. With the multi-turn coil spring 94 which is so compactly arranged in concentric relationship with the corner seal, there is thus provided balanced loading on the corner seal and with a substantially greater amount of elastic travel within the stress limits of the spring's material as compared with the typical corner seal spring of stamped sheet metal or single loop wire. Thus the coil spring 94 can provide higher spring loads on the corner seal with reasonable spring rates as compared with the typical corner seal leaf or single loop wire spring arrangement.

The above described embodiment is illustrative of the invention which may be modified within the scope of the appended claims.

I claim:

1. In a rotary machine, a housing having an inwardly facing inner peripheral wall and a pair of spaced oppositely facing inner end walls, a rotor rotatably mounted in said housing having sides opposite said end walls and a plurality of corners that remain adjacent said peripheral wall as said rotor rotates, said rotor and said housing walls cooperatively defining a plurality of chambers separated by said rotor corners that expand and contract as said rotor rotates, each said rotor corner having an apex seal slot extending thereacross facing radially outwardly toward said peripheral wall, each said rotor side at each corner having a corner seal hole immediately joining with one of said apex seal slots and facing outwardly toward one of said end walls, each said rotor side further having a side seal groove extending along the periphery of said rotor side and joining at opposite ends with two of said corner seal holes, apex seal means mounted in each said apex seal slot and extending at opposite ends into the adjoining corner seal holes, a side seal mounted in each said side seal groove and extending at opposite ends into the adjoining corner seal holes and engaging the opposite end wall, a corner seal mounted in each said corner seal hole for engaging the opposite end wall, each said corner seal having a centerline and a periphery engaged by the ends of two adjoining side seals and also having an apex seal slot receiving the adjoining apex seal means whereby the corner seal provides a sealed juncture between the adjoining apex seal means and two side seals, a leaf spring having a center portion seated on the bottom of each apex seal slot in said rotor and having end portions extending into the adjoining corner seal holes to engage and urge the apex seal means radially outward against said peripheral wall, each said corner seal having a relieved portion in the backside thereof, and each said apex seal means having a relieved portion cooperating with the relieved portion in the adjoining corner seal to provide an annular space about the adjoining spring end portion concentric with the corner seal and within the accommodating corner seal hole between the corner seal and the bottom of the accommodating corner seal hole, and a multi-coil coil spring mounted in each said annular space concentric with the adjoining corner seal for biasing the corner seal outward against the opposite end wall.

2. In a rotary machine, a housing having an inwardly facing inner peripheral wall and a pair of spaced oppositely facing inner end walls, a rotor rotatably mounted in said housing having sides opposite said end walls and a plurality of corners that remain adjacent said peripheral wall as said rotor rotates, said rotor and said housing walls cooperatively defining a plurality of chambers separated by said rotor corners that expand and contract as said rotor rotates, each said rotor corner having an apex seal slot extending thereacross facing radially outwardly toward said peripheral wall, each said rotor side at each corner having a cylindrical corner seal hole immediately joining with one of said apex seal slots and facing outwardly toward one of said end walls, each said rotor side further having a side seal groove extending along the periphery of said rotor side and joining at opposite ends with two of said corner seal holes, apex seal means mounted in each said apex seal slot and extending at opposite ends into the adjoining corner seal holes for engaging said peripheral wall, a side seal mounted in each said side seal groove and extending at opposite ends into the adjoining corner seal holes and engaging the opposite end wall, a cylindrical corner seal mounted in each said corner seal hole for engaging the opposite end wall, each said corner seal having a centerline and a periphery engaged by the ends of two adjoining side seals and also having an apex seal slot receiving the adjoining apex seal means whereby the corner seal provides a sealed juncture between the adjoining apex seal means and two side seals, a leaf spring having a center portion seated on the bottom of each apex seal slot in said rotor and having end portions extending into the adjoining corner seal holes to engage and urge said apex seal means radially outward against said peripheral wall, each said corner seal and adjoining apex seal means having recesses cooperatively providing an annular space about the adjoining spring end portion concentric with the corner seal and within the accommodating corner seal hole between the corner seal and the bottom of the accommodating corner seal hole, and a multi-coil coil spring mounted in each said annular space concentric with the adjoining corner seal for biasing the corner seal outward against the opposite end wall.

3. In a rotary machine, a housing having an inwardly facing inner peripheral wall and a pair of spaced oppositely facing inner end walls, a rotor rotatably mounted in said housing having sides opposite said end walls and a plurality of corners that remain adjacent said peripheral wall as said rotor rotates, said rotor and said housing walls cooperatively defining a plurality of chambers separated by said rotor corners that expand and contract as said rotor rotates, each said rotor corner having an apex seal slot extending thereacross facing radially outwardly toward said peripheral wall, each said rotor side at each corner having a cylindrical corner seal hole immediately joining with one of said apex seal slots and facing outwardly toward one of said end walls, each said rotor side further having a side seal groove extending along the periphery of said rotor side and joining at opposite ends with two of said corner seal holes, apex seal means including a center piece and two end pieces having inclined interfaces mounted in each said apex seal slot and extending at opposite ends into the adjoining corner seal holes, a side seal mounted in each said side seal groove and extending at opposite ends into the adjoining corner seal holes and engaging the opposite end wall, a cylindrical corner seal mounted in each said corner seal hole for engaging the opposite end wall, each said corner seal having a centerline and a periphery engaged by the ends of two adjoining side seals and also having an apex seal slot receiving the adjoining apex seal means whereby the corner seal provides a sealed juncture between the adjoining apex seal means and two side seals, a leaf spring having a center portion seated on the bottom of each apex seal slot in said rotor and having end portions extending into the adjoining corner seal holes to engage said apex seal end pieces whereby said inclined interfaces act to force the apex seal end pieces axially outwardly against the opposite end walls and also force the apex seal center piece radially outward against said peripheral wall, each said corner seal having a concentric blind bore in the backside thereof, and said interfaces of said apex seal pieces having triangular shaped notches cooperating with the blind bore in the adjoining corner seal to provide an annular space about the adjoining spring end portion concentric with the corner seal and within the accommodating corner seal hole between the corner seal and the bottom of the accommodating corner seal hole, and a multi-coil coil spring mounted in each said annular space concentric with the adjoining corner seal for biasing the corner seal outward against the opposite end wall.

* * * * *